US006440624B2

(12) United States Patent
Nihei

(10) Patent No.: US 6,440,624 B2
(45) Date of Patent: Aug. 27, 2002

(54) IMAGE FORMING METHOD AND APPARATUS EMPLOYING FERROELECTRICS, AND IMAGE FORMATION MEDIUM

(75) Inventor: Yasukazu Nihei, Kaisei-machi (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/809,286

(22) Filed: Mar. 16, 2001

(30) Foreign Application Priority Data

Mar. 16, 2000 (JP) ..... 2000-073235
Dec. 25, 2000 (JP) ..... 2000-392708

(51) Int. Cl.[7] ..... G03G 15/05; G03G 5/02
(52) U.S. Cl. ..... 430/51; 347/114; 427/466
(58) Field of Search ..... 430/51, 66, 84, 430/95; 347/114; 427/466

(56) References Cited

U.S. PATENT DOCUMENTS 5,079,200 A * 1/1992 Jackson
5,927,206 A * 7/1999 Bacon et al. ..... 101/453

OTHER PUBLICATIONS

Technical Report of IEICE, EED 98–180 Mar. 1999; Katsuyoshi Hoshino; "Ferroelectric Imaging, Rewritable Recording Medium with a Memory Effect".

Japanese Journal of Applied Physics; Takuji Matsumoto, et al.; "Ferroelectric Imaging: A Proposal for Formation of Long–Life Electrostatic Images"; vol. 37, 1998, pp. 3402–3407.

* cited by examiner

*Primary Examiner*—John Goodrow
(74) *Attorney, Agent, or Firm*—Sughrue, Mion, PLLC

(57) ABSTRACT

A polarization reversion pattern is formed in ferroelectrics in accordance with image information. An image is obtained by surface charges corresponding to the polarization reversion pattern. The ferroelectrics are composed of an inorganic ferroelectric oxide such as $LiNb_xTa_{1-x}O_3(0 \leqq x \leqq 1)$.

60 Claims, 11 Drawing Sheets

IMAGE FORMING METHOD AND APPARATUS EMPLOYING FERROELECTRICS, AND IMAGE FORMATION MEDIUM

BACKGROUND OF THE INVENTION

1. Field of the Invention

The present invention relates to an image forming method that employs ferroelectrics, and more particularly to a method of forming an image by forming a polarization reversion pattern in ferroelectrics in accordance with image information.

The invention also relates to an apparatus for carrying out the image forming method which employs ferroelectrics, and an image formation medium that is employed in the image forming method.

2. Description of the Related Art

Electrophotography (Carlson method) is widely known as one of the image recording methods. The electrophotography is the process of recording an image, by forming an electrostatic latent image in a photosensitive substance, then developing this electrostatic latent image with toner, and transferring the toner image to recording paper.

The photosensitive substance that is employed in this electrophotography has the disadvantage that the time during which electric potential is held since the surface was charged is short and that electric potential will attenuate (dark attenuation). Because of this, it is necessary to quickly perform the write process of forming an electrostatic latent image in the photosensitive substance uniformly charged. It is also necessary to perform the development and transfer of the formed electrostatic latent image quickly.

In view of the aforementioned circumstances, various investigations and experiments have been made with respect to a memory type photosensitive substance. However, there has not yet been reported any practical memory-type photosensitive substance meeting all the following requirements: (1) memory service life is long; (2) memory formation sensitivity is high; (3) a substance that functions as memory does not degrade the sensitivity of the photosensitive substance; and (4) formation and erasion of memory are reversible.

Hence, there have been proposed a wide variety of image forming methods for forming an electrostatic latent image by use of a medium, having a memory function, which is entirely different from the conventional photosensitive substance employed in the Carlson method.

Such an image forming method has been proposed, for example, in SHINGAKU Technical Report EID 98-180, issued by the Academic Society for Electronic Information Communication. A distribution of heat corresponding to image information is applied to ferroelectrics simultaneously with application of an electric field, in order to form a polarization reversion pattern in the ferroelectrics in accordance with the image information. Then, a change in temperature is applied to the ferroelectrics so that surface charges corresponding to the polarization reversion pattern are generated by a pyroelectric effect. With the surface charges, an electrostatic latent image is obtained.

The image forming method described in the aforementioned Report EID 98-180, however, has the problem that reliability in image formation is low, because an organic polymer material being employed as ferroelectrics, more particularly a vinylidene fluoride polymer, is low in thermal durability.

SUMMARY OF THE INVENTION

The present invention has been made in view of the problem found in the prior art. Accordingly, it is an important object of the present invention to provide an image forming method, employing ferroelectrics, which is capable of enhancing reliability in image formation.

Another important object of the invention is to provide an image forming apparatus in which reliability in image formation has been enhanced.

Still another important object of the invention is to provide an image formation medium, formed from ferroelectrics whose thermal durability are high, which is capable of making a contribution to a reliability enhancement in image formation.

To achieve the aforementioned objects of the present invention and in accordance with an important aspect of the present invention, there is provided a first image forming method comprising the steps of: forming a polarization reversion pattern in ferroelectrics in accordance with image information; and obtaining an electrostatic latent image by surface charges corresponding to the polarization reversion pattern; wherein an inorganic ferroelectric oxide is employed as the ferroelectrics.

In accordance with another important aspect of the present invention, there is provided a second image forming method comprising the steps of: subjecting ferroelectrics to a distribution of heat corresponding to image information simultaneously with application of an electric field, in order to form a polarization reversion pattern in the ferroelectrics in accordance with the image information; applying a change in temperature to the ferroelectrics so that surface charges corresponding to the polarization reversion pattern are generated by a pyroelectric effect; and obtaining an electrostatic latent image by the surface charges; wherein an inorganic ferroelectric oxide is employed as the ferroelectrics.

It is preferable that the inorganic ferroelectric oxide be a thin film with metal alkoxides as raw materials and also preferable that the inorganic ferroelectric oxide be $LiNb_xTa_{1-x}O_3$ ($0 \leqq x \leqq 1$).

To subject the inorganic ferroelectric oxide to the distribution of heat corresponding to image information, as described above, it is preferable to adopt an exposure method of irradiating infrared light carrying image information to the inorganic ferroelectric oxide. In such a case, it is desirable that the inorganic ferroelectric oxide contain a dopant that absorbs the infrared light carrying image information and also desirable that the dopant be composed of at least any one of elements Mg, Ti, Cr, Ni, Cu, Zn, Zr, Nb, Mo, Rh, Ag, In, Sn, Au, and Pb.

In the second image forming method, it is desirable that a photothermal conversion body in the form of a layer be disposed in close proximity or intimate contact with an image formation layer that consists of an inorganic ferroelectric oxide. The photothermal conversion body is used for absorbing the infrared light carrying image information, converting it into heat, and applying the heat to the image formation layer.

A conductive film may be disposed on one surface of the inorganic ferroelectric oxide, and an electric field may be applied across the inorganic ferroelectric oxide through the conductive film. The conductive film may be constructed of a conducting portion formed over the entire surface, or micro conducting portions and non-conducting portions. The micro conducting portions and non-conducting portions may be alternated in predetermined cycles. In the case of employing the inorganic ferroelectric oxide containing a dopant that absorbs infrared light, it is desirable that the conductive film be transparent to infrared light. In the case where the photothermal conversion body is employed, the conductive film may be an opaque conductive film such as metal.

In the image forming method of the present invention, it is desirable to perform application of an electric field by a corona charging method.

In the image forming method of the present invention, as described above, it is desirable to form a polarization reversion pattern in an inorganic ferroelectric oxide in accordance with image information, obtain an electrostatic latent image by surface charges corresponding to the polarization reversion pattern, develop the electrostatic latent image as a toner image, and transfer this toner image to recording paper.

An image forming apparatus according to the present invention performs image formation by the image forming methods of the present invention described above.

An image formation medium according to the present invention is employed in the image forming methods of the present invention described above and has an image formation layer composed of an inorganic ferroelectric oxide.

In a preferred form of the image formation medium, the image formation layer is constructed of an inorganic ferroelectric oxide containing a dopant that absorbs infrared light carrying image information. The dopant is composed of at least any one of elements Mg, Ti, Cr, Ni, Cu, Zn, Zr, Nb, Mo, Rh, Ag, In, Sn, Au, and Pb.

In another preferred form of the image formation medium, a photothermal conversion body in the form of a layer, which absorbs infrared light carrying image information and converts it into heat and applies the heat to the image formation layer, is disposed in close proximity or intimate contact with the image formation layer.

It is preferable that the inorganic ferroelectric oxide constituting the image formation layer of the image formation medium of the present invention be a thin film with metal alkoxides as raw materials and also preferable that the inorganic ferroelectric oxide be $LiNb_xTa_{1-x}O_3$ ($0 \leqq x \leqq 1$).

In the image formation medium of the present invention, it is desirable that a conductive film be disposed on one surface of the inorganic ferroelectric oxide. The conductive film may be constructed of a conducting portion formed over the entire Surface, or micro conducting portions and non-conducting portions. The micro conducting portions and non-conducting portions may be alternated in predetermined cycles. In the case of employing the inorganic ferroelectric oxide containing a dopant which absorbs infrared light, it is desirable that the conductive film be transparent to infrared light. In the case where the photothermal conversion body is employed, the conductive film may be an opaque conductive film such as metal.

The steps of the image forming method, employing ferroelectrics, of the present invention will be described with reference to FIG. 1. As illustrated in the figure, an image formation medium 1 is constructed of an inorganic ferroelectric oxide film 2, which becomes an image formation layer, a conductive film 3 formed on the inorganic ferroelectric oxide film 2 (in FIG. 1, on the bottom surface), and a photothermal conversion film 4 formed on the conductive layer 3.

The image formation medium 1 is polarized in one direction prior to image formation by application of an electric field, as illustrated in FIG. 1A. This process will hereinafter be referred to as a unipolar polarization process. Then, light 5 (e.g., infrared light) carrying image information is irradiated toward the inorganic ferroelectric oxide film 2 through the photothermal conversion film 4, as illustrated in FIG. 1B. This light 5 is absorbed in the photothermal conversion film 4 and converted into heat. With the heat, the inorganic ferroelectric oxide film 2 is heated. At the same time, an electric field is applied across the inorganic ferroelectric oxide film 2 without contact by a corona charging head 6. At this time, at only an exposed portion of the inorganic ferroelectric oxide film 2 irradiated with the light 5, a polarization reversion threshold value for the inorganic ferroelectric oxide film 2 is reduced by heating. Therefore, only the exposed portion is reversed in polarization direction by suitably setting a value for the electric field. In this manner, a polarization reversion pattern is formed in the inorganic ferroelectric oxide film 2 in accordance with image information.

Next, if the temperature of the entire inorganic ferroelectric oxide film 2 is varied, surface charges are generated by the pyroelectric effect, as illustrated in FIG. 1C. Since a polarization-reversed portion and a non-reversed portion have charges of opposite polarities, contrast potential develops, so that an electrostatic latent image is formed. Because electric polarization is high in stability, surface charges occur at any time by varying the temperature of the inorganic ferroelectric oxide film 2. In other words, the image formation medium 1 with the inorganic ferroelectric oxide film 2 has a memory function.

Next, if toner 7 is applied to the inorganic ferroelectric oxide film 2, the toner 7 is attached only to one of the charge polarities by electrostatic force, as illustrated in FIG. 1D. In this manner, the above-mentioned electrostatic latent image is developed as a toner image. The toner 7 can be attached to either only polarization-reversed portions or only non-reversed portions, depending on selection of the toner 7. This toner image, as in the Carlson method, etc., is transferred to recording paper with a transfer charger, etc.

As illustrated in FIG. 1E, a movable electrode 8 is brought into intimate contact with the inorganic ferroelectric oxide film 2, and by applying voltage with a dc power source 9, all polarization directions are reset. If voltage is set higher than the case of the application of an electric field shown in FIG. 1B, all polarization directions can be reset and returned to the initial state in FIG. 1A. That is, reversibility of the polarization reversion makes it possible to erase memory contents arbitrarily. If heat is applied to the inorganic ferroelectric oxide film 2 in the reset or initial state, a polarization reversion threshold value can be lowered.

As described above, the image forming method, employing ferroelectrics, of the present invention has a more stable, electrostatic latent image and is writable and capable of exhibiting superiority over on-demand printing, etc., which are required to print a small number of sheets, to have instancy, and to be writable.

The inorganic ferroelectric oxide, which is employed as ferroelectrics in the image forming method of the present invention, is appreciably higher in thermal durability, compared with organic polymer materials such as the aforementioned vinylidene fluoride polymer, etc. Therefore, in the image forming method of the present invention, which employs an inorganic ferroelectric oxide such as this, image formation reliability becomes sufficiently high.

As described previously, if a distribution of heat corresponding to image information is applied to an inorganic ferroelectric oxide simultaneously with application of an electric field, polarization reversion threshold values for only the heated portions of the inorganic ferroelectric oxide are reduced. Hence, if a value for the electric field is suitably set, polarization reversion occurs only at the heated portions of the inorganic ferroelectric oxide, so that a polarization reversion pattern is formed according to image information.

As described above, in the case where the exposure method, for irradiating infrared light carrying image information to an inorganic ferroelectric oxide, is performed in order to subject the inorganic ferroelectric oxide to a distribution of heat corresponding to image information, heat of the infrared light is absorbed satisfactorily in the inorganic ferroelectric oxide, if the inorganic ferroelectric oxide contains a dopant which absorbs the infrared light carrying image information. Consequently, accurate exposure to infrared light is performed according to image information.

As another method of irradiating infrared light to an organic ferroelectric oxide, a photothermal conversion body in the form of a layer may be disposed in close proximity or intimate contact with an image formation layer consisting of an inorganic ferroelectric oxide. The photothermal conversion body is used for absorbing infrared light carrying image information and converting it into heat and applying the heat to the image formation layer. This case is also capable of performing accurate exposure to infrared light in accordance with image information, because the heat converted efficiently from infrared light is absorbed satisfactorily in the inorganic ferroelectric oxide.

For this exposure to infrared light, high-output infrared laser light, etc., can be employed as the exposure light. This renders it possible to obtain an image pattern without a dark-room process.

In addition, if a conductive film is disposed on one surface of the aforementioned inorganic ferroelectric oxide, and an electric field is applied across the inorganic ferroelectric oxide through this conductive film, the electric field can be applied uniformly across the inorganic ferroelectric oxide.

The conductive film, in addition to a film whose conducting portion is formed over the entire surface, may also be a film constructed of micro conducting portions and non-conducting portions. In that case, if the conducting portions and non-conducting portions are alternated in predetermined cycles, a quantity of surface charge at a polarization-reversed portion can be controlled in the organic ferroelectric oxide by the effect of canceling adjacent charges (i.e., electric charge on a portion corresponding to the aforementioned conducting portion and electric charge on a portion corresponding to the non-conducting portion) occurring on the polarization-reversed portion. More specifically, if a ratio of micro conducting portions and non-conducting portions is 1:1, a quantity of surface charge at a polarization-reversed portion will approach zero. If the quantity of surface charge for the inorganic ferroelectric oxide can be controlled in this manner, selection of toners will become wider in the case of developing an electrostatic latent image as a toner image.

FIG. 2 illustrates how the above-mentioned quantity of surface charge is controlled. An image formation medium 1' shown in FIG. 2 differs from the image formation medium 1 shown in FIG. 1, in that a conductive film 3', which consists of micro conducting portions and non-conducting portions alternated in predetermined cycles, is formed instead of the conductive layer 3. Note that the steps shown in FIGS. 2A and 2B correspond to the steps shown in FIGS. 1C and 1D, respectively.

If the conductive film 3' whose ratio of micro conducting portions and non-conducting portions is 1:1 is employed, as illustrated in FIG. 2A, the surface charge on a polarization-reversed portion will approach zero. Consequently, toner 7 can be attached only on non-reversed portions without being attached on the polarization-reversed portion, depending on selection of the toner 7.

In the case of employing an image formation medium containing a dopant which absorbs infrared light, it becomes necessary for the conductive film to be transparent to infrared light. In the case where the aforementioned photothermal conversion body is employed, an opaque conductive film such as metal may be employed.

The image forming method of the present invention is capable of not only developing an electrostatic latent image with toner and transferring it to recording paper, as described above, but also displaying an image on an image display medium which also serves as an image formation medium. Such an image display method will hereinafter be described in detail.

First, the basic mechanism of an image display method, employing ferroelectrics, of the present invention will be described with reference to FIG. 7. Initially, a description will be given of how a monochrome image is displayed. Reference numeral 101 denotes an image display medium employed in the present invention. The image display medium 101 has a ferroelectric thin film 102, and a contrast display body 103 joined to one surface of the ferroelectric thin film 102. The ferroelectric thin film 102 is formed on a transparent electrode 104 by way of example.

The ferroelectric thin film 102 of the image display medium 101 is subjected to the unipolar polarization process and reset prior to image display by application of an electric field, as illustrated in FIG. 7A. Note that arrows in the ferroelectric thin film 102 of FIG. 7 indicate directions of polarization, respectively. Next, light (e.g., infrared light) 105 carrying image information is irradiated toward the ferroelectric thin film 102 through the transparent electrode 104, as illustrated in FIG. 7B. To make the light 105 carry image information, the light 105 is scanned two-dimensionally on the ferroelectric thin film 112, for example, with the intensity modulated. At this time, only portions of the ferroelectric thin film 102 irradiated with the light 105 are reversed in polarization direction by heating.

Note that in the case where a threshold voltage for the polarization reversion is high, the threshold voltage can be lowered by applying bias voltage across the entire ferroelectric thin film 102, or by raising the ferroelectric thin film 102 to high temperature.

If the polarization direction of the ferroelectric thin film 102 reverses, the surface charge occurring on the surface (joined to the contrast display body 103) is reversed in polarity, so that a charge distribution pattern (electrostatic latent image) is formed in accordance with the polarization reversion pattern. As illustrated in FIG. 7C, the contrast display body 103 emits color in accordance with electric charge. In this manner, only portions of the contrast display body 103 irradiated with the light 105 emit color, so the image carried by the light 105 is displayed on the contrast display body 103.

Note that the ferroelectric thin film 102 basically has a polarization of 180 degrees. This image display medium 101 has a memory function, because polarization reversion does not return to its original state unless a high electric field is applied.

As illustrated in FIG. 7D, if one electrode of a dc power supply 106 is connected to the transparent electrode 104, and an electric field is applied across the ferroelectric thin film 102 without contacting the film 102, for example, by a corona head 107 connected with the other electrode of the dc power supply 106, all polarization directions are reset. If the voltage is set higher than the case of the application of the electric field shown in FIG. 7B, all polarization directions can be reset and return to the state shown in FIG. 7A. That is, reversibility of the polarization reversion allows memory contents to be erased arbitrarily, so that rewriting (i.e., display) is possible.

Next, the case of color image display will be described with reference to FIG. 8. An image display medium 111 in this case has a ferroelectric thin film 112, and a contrast display body 113 joined to one surface of the ferroelectric thin film 112. The ferroelectric thin film 112 is formed on a transparent electrode 114 through a photothermal conversion film 116 by way of example.

A photothermal conversion film 116 is made up of three kinds of heating elements 116R, 116G, and 116B disposed regularly. These three kinds of heating elements 116R, 116G, and 116B selectively absorb infrared light of different wavelengths λ1, λ2, and λ3 and converts into heat, respectively. The basic spectral-absorptance characteristics for these heating elements 116R, 116G, and 116B are illustrated in FIG. 10A. The size of the heating elements 116R, 116G, and 116B corresponds to the size of a pixel required of a display image and is, for example, about a few μm square.

The contrast display body 113 is made up of color-emitting materials 113R, 113G, and 113B, which emit red, green, and blue in accordance with electric charge received from the outside. The color-emitting materials 113R, 113G, and 113B are disposed at positions corresponding to the heating elements 116R, 116G, and 116B, respectively. The size of the color-emitting materials 113R, 113G, and 113B is the same as that of the heating elements 116R, 116G, and 116B.

The ferroelectric thin film 112 of the image display medium 111 is subjected to the unipolar polarization process and reset prior to image display by application of an electric field, as illustrated in FIG. 8A. Then, infrared light 115 of wavelength λ1 carrying red image information is irradiated toward the photothermal conversion film 116 through the transparent electrode 114, as illustrated in FIG. 8B. To cause the infrared light 115 to carry red image information, the infrared light 115 is scanned in two dimensions on the ferroelectric thin film 112, for example, with the intensity modulated. At this time, only the heating element 116R, irradiated with infrared light 115, of the heating elements 116R, 116G, and 116B of the photothermal conversion film 116 absorbs the infrared light 115 and generates heat.

A portion of the ferroelectric thin film 112 in contact with the heating element 116 generating heat is reversed in polarization direction by the received heat. If the polarization direction of the ferroelectric thin film 112 is reversed, the surface charge occurring on the surface reverses in polarity, so that the color-emitting material 113R at a position corresponding to this polarization-reversed portion (i.e., at a position corresponding to the heating element 116R generating heat) emits red.

In parallel with irradiation of the infrared light 115 of wavelength λ1, the infrared light of wavelength λ2 carrying green image information is scanned in two dimensions on the ferroelectric thin film 112. As a result, only the heating element 116G, irradiated with the infrared light of wavelength λ2, of the heating elements 116R, 116G, and 116B of the photothermal conversion film 116 absorbs the infrared light 115 and generates heat. As with the aforementioned case of red, the color-emitting material 113G at a position corresponding to the heating element 116G generating heat emits green.

Similarly, the infrared light 115 of wavelength λ3 carrying blue image information is scanned in two dimensions on the ferroelectric thin film 112, and only the heating element 116G, irradiated with the infrared light 115 of wavelength λ3, of the heating elements 116R, 116G, and 116B of the photothermal conversion film 116 absorbs the infrared light 115 and generates heat. As with the aforementioned case, the color-emitting material 113B at a position corresponding to the heating element 116B generating heat emits blue.

In the manner described above, the color emissions of the color-emitting materials 113R, 113G, and 113B arrayed in the contrast display body 113 are controlled based on red image information, green image information, and blue image information, respectively. Consequently, a full color image can be displayed on the contrast display body 113 in accordance with the red, green, and blue image information.

This case, as with the case of monochrome image display, is also capable of erasing a display image by resetting all the polarization directions of the ferroelectric thin film 112.

The pixel unit of an image to be displayed here is determined by the size of the color-emitting materials 113R, 113G, and 113B of the contrast display body 113. Therefore, if the size of these color-emitting materials 113R, 113G, and 113B and the size of the heating elements 116R, 116G, and 116B are made smaller, resolution for a display image will become higher. As described above, the size of the heating elements 116R, 116G, and 116B is about a few μm square, and it has already been confirmed that polarization reversion can also be controlled in ferroelectrics in the unit of such a size. In practice, it is possible to reduce the pixel size down to the beam diameter of laser light, such as infrared light for scanning.

Note that in some cases, such as where the ferrroelectric thin film 112 itself is able to generate heat when irradiated with infrared light by reason of it containing a dopant that absorbs infrared light, or for other reasons, a color image can also be displayed by a structure such as that shown in FIG. 9. A description will hereinafter be made of this structure. Notice in FIG. 9 that the same reference numerals will be applied to the same elements as those in FIG. 8 and that a description thereof will not be given unless particularly necessary (the same applies to the following description).

In an image display medium 111' shown in FIG. 9, a light transmission film 117 is disposed instead of the photothermal conversion film 16 employed in the structure of FIG. 8. This light transmission film 117 consists of three kinds of micro filters 117R, 117G, and 117B disposed regularly. These three kinds of micro filters 117R, 117G, and 117B selectively transmit infrared light of different wavelengths λ1, λ2, and λ3, respectively. The basic spectral-transmittance characteristics for these micro filters 117R, 117G, and 117B are illustrated in FIG. 10B.

In this construction, the polarization reversion of the ferroelectric thin film 112 is controlled in the unit of the size of the micro filters 117R, 117G, and 117B by infrared light being transmitted through the micro filters 117R, 117G, and 117B. Therefore, this case is also capable of displaying a full color image on the contrast display body 11 by controlling the colors that are emitted by the color-emitting materials 113R, 113G, and 113B of the contrast display body 113.

In the case where the ferroelectric thin film 112 generates no heat by itself, in the construction of FIG. 9 a photothermal conversion film may be interposed between the ferroelectric thin film 112 and the light transmission film 117. In this case, the photothermal conversion film is caused to generate heat in the unit of the size of the micro filters 117R, 117G, and 117B of the light transmission film 117 by the infrared light transmitted through the micro filters 117R, 117G, and 117B. With the generated heat, the polarization direction of the ferroelectric thin film 112 is reversed.

As has been described above, the image display method employing the image forming method of the present invention displays an image by controlling the polarization reversion of ferroelectrics with irradiation of infrared light, etc. Consequently, the image display method is capable of making a display of an image which has a memory function, by employing inexpensive equipment that does not have such an elaborate drive circuit that controls application of voltage in the unit of a pixel.

The inorganic ferroelectric oxide, which is employed as preferred ferroelectrics in the image display method employing the image forming method of the present invention, is remarkably higher in thermal durability, compared with organic polymer materials such as a vinylidene fluoride polymer, etc. Therefore, in the case where such an inorganic ferroelectric oxide is particularly employed in the image display method of the present invention, image display reliability becomes sufficiently high.

In addition, in the case where infrared light carrying image information is irradiated to a ferroelectric oxide in order to subject the ferroelectrics to a distribution of heat corresponding to image information, heat of the infrared light is absorbed satisfactorily in the ferroelectrics, if the ferroelectric contains a dopant which absorbs the infrared light carrying image information. Consequently, an accurate image can be displayed according to image information.

As another method of irradiating infrared light to ferroelectrics, a photothermal conversion body in the form of a layer may be disposed in close proximity or intimate contact with the ferroelectrics. The photothermal conversion body is used for absorbing infrared light carrying image information and converting into heat and applying the heat to the ferroelectrics. This case is also capable of displaying an accurate image in accordance with image information, because the heat converted efficiently from infrared light is absorbed satisfactorily in the ferroelectrics.

In the case where a combination of micro photothermal conversion portions and non-conversion portions, preferably a combination of micro photothermal conversion portions and non-conversion portions alternated in predetermined cycles, is used as the aforementioned photothermal conversion body, a quantity of surface charge at a polarization-reversed portion can be controlled in ferroelectrics by the effect of canceling adjacent charges (i.e., electric charge on a portion corresponding to the aforementioned photothermal conversion portion and electric charge on a portion corresponding to the non-conversion portion) occurring on the polarization-reversed portion. More specifically, if a ratio of micro photothermal conversion portions and non-conversion portions is 1:1, a quantity of surface charge at a polarization-reversed portion will approach zero.

In such a case, for example, the surface charge on a portion of the ferroelectrics irradiated with infrared light can be made to approach zero, and a portion not irradiated with infrared light will be left in a surface charge state remaining reset. Therefore, in the case where electrochromic material is employed as the contrast display body, for instance, contrast can be displayed by developing an electrochromic phenomenon at the latter portion and not developing it at the former portion. Thus, if a photothermal conversion body, consisting of micro photothermal conversion portions and non-conversion portions, is employed, the degree of freedom for selection of contrast display bodies can be enhanced.

In addition, when a conductive film is disposed on one surface of ferroelectrics, and bias voltage is applied across the ferroelectrics through this conductive film, a combination of micro conducting portions and non-conducting portions, preferably a combination of micro conducting portions and non-conducting portions alternated in predetermined cycles, can be be used as the conductive film. This case is also capable of controlling a quantity of surface charge occurring on the ferroelectrics by the effect of canceling adjacent charges occurring on a polarization-reversed portion. More specifically, a threshold voltage for polarization reversal is reduced at a portion of the ferroelectrics corresponding to the conducting portion by the effect of application of bias voltage, so that polarization reversal is facilitated. On the other hand, such a facilitated operation is not obtained at a portion of the ferroelectrics corresponding to the non-conducting portion. Hence, if a conductive film whose ratio of micro conducting portions and non-conducting portions is 1:1 is employed, for example, surface charge is caused to approach zero by application of bias voltage.

In such a case, by irradiating infrared light to ferroelectrics, for example, the irradiated portion is caused to be in a state where surface charge is not zero. Therefore, in the case where electrochromic material is employed as the contrast display body, for instance, contrast can be displayed by developing an electrochromic phenomenon at a portion irradiated with infrared-light and not developing it at a portion non irradiated. Thus, even if a photothermal conversion body, consisting of micro photothermal conversion portions and non-conversion portions, is employed, the degree of freedom for selection of contrast display bodies can be enhanced.

BRIEF DESCRIPTION OF THE DRAWINGS

The present invention will be described in further detail with reference to the accompanying drawings wherein.

DESCRIPTION OF THE PREFERRED EMBODIMENTS

Embodiments of the present invention will hereinafter be described with reference to the drawings. FIG. 3 illustrates the steps of an image forming method, employing ferroelectrics, of a first embodiment of the present invention. An image formation medium 10 in the first embodiment consists of a thin film of $LiNbO_3$ (hereinafter referred to as an LN thin film 11), which is an organic ferroelectric oxide, and a carbon conductive film 12, formed on the LN thin film 11 (in FIG. 3, on the bottom surface), which serves as both a conductive film and a photothermal conversion film.

The LN thin film 11 is formed by hydrolysis of $LiOC_2H_5$ and $Nb(OC_2H_5)$, with the metal alkoxides as starting materials (sol-gel method). The film thickness is 2 $\mu$m as an example. It is preferable that a low-temperature composite thin film formed by hydrolysis of metal alkoxides be 100 $\mu$m or less in thickness, because cracks are liable to occur if the thickness increases.

Figure 1A:
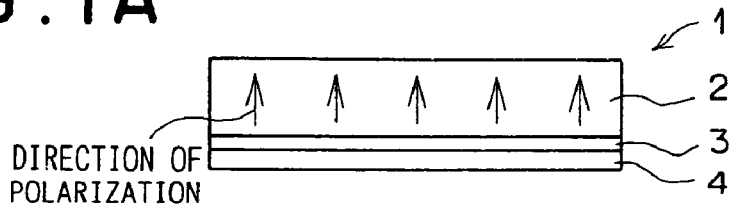
FIGS. 1A to 1E are schematic diagrams showing the steps of an image forming method of the present invention.
Figure 1B:
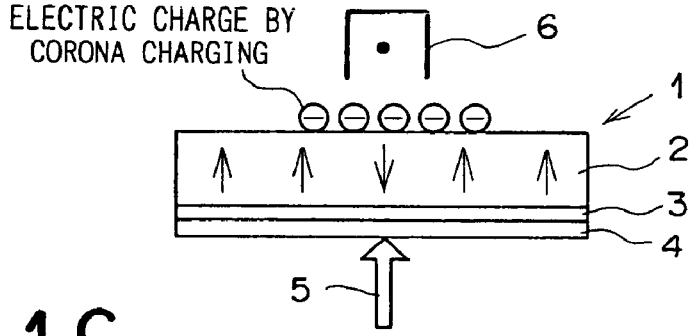
Figure 1C:
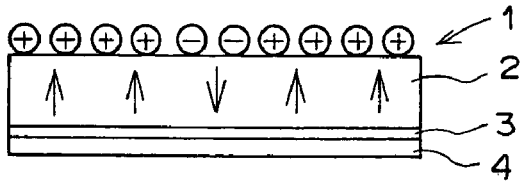
Figure 1D:
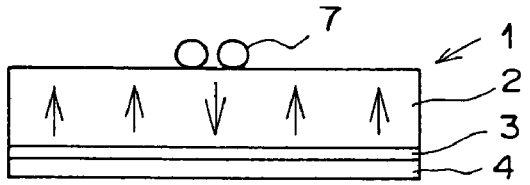
Figure 1E:
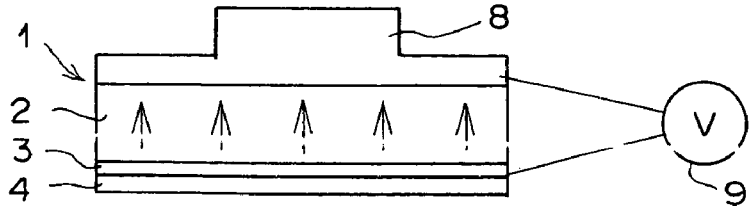
Figure 2A:
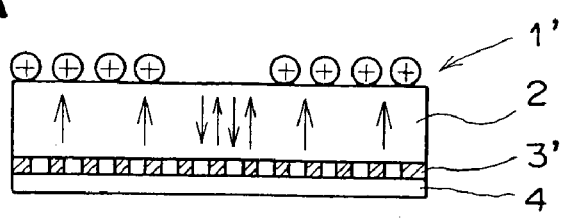
FIGS. 2A and 2B are schematic diagrams showing some of the steps of an image forming method of a second embodiment of the present invention.
Figure 2B:
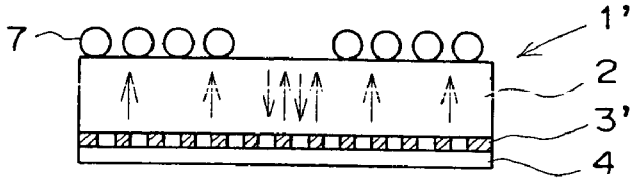
Figure 3A:
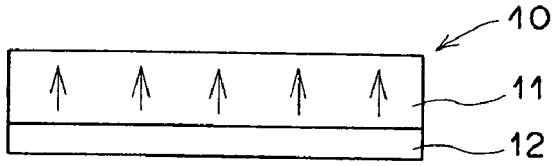
FIGS. 3A to 3C are schematic diagrams showing the steps of an image forming method, employing ferroelectrics, of a first embodiment of the present invention.
Figure 3B:
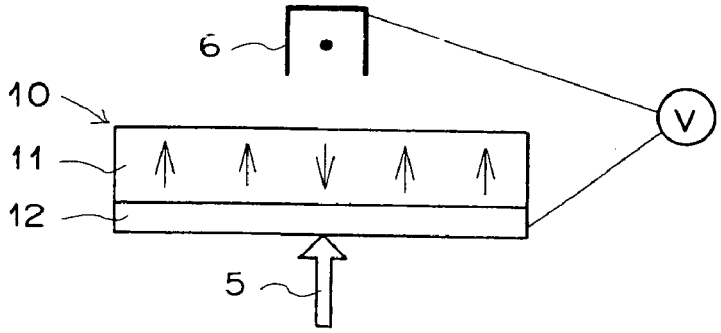

The LN thin film 11 is subjected to the unipolar polarization process prior to image formation by application of an electric field, as illustrated in FIG. 3A. Then, light carrying image information, such as high-output infrared laser light 5, is irradiated to the LN thin 11 through the carbon conductive film 12, as illustrated in FIG. 3B. In the first embodiment, the LN thin film 11 is exposed based on image information, by modulating and scanning the infrared laser light 5, based on the image information.

The infrared laser light 5 is absorbed in the carbon conductive film 12 and converted into heat. With the heat, the LN thin film 11 is heated. At the same time, an electric field is applied across the LN thin film 11 without contact by a corona charging head 6. At this time, at only an exposed portion of the film 11 irradiated with the infrared laser light 5, a polarization reversion threshold value for the LN thin film 11 is reduced by heating. Therefore, only the exposed portion is reversed in polarization direction by suitably setting a value for an electric field.

Note that in the first embodiment, the output of the infrared laser light 5 is 1 W and the corona charging voltage is 30 V.

Figure 3C:
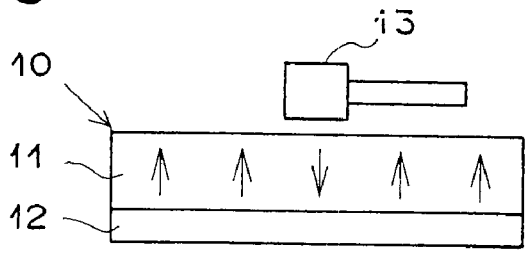

Thereafter, if the temperature of the LN thin film 11 is varied from room temperature to 100° C. as an example, surface charges are generated by the pyroelectric effect. As illustrated in FIG. 3C, if the surface charges are measured by a surface electrometer 13, it can be confirmed that the polarization-reversed portion and the non-reversed portion have opposite polarities. From this it has also been confirmed that an electrostatic latent image has been formed according to the aforementioned image information.

If the LN thin film 11 is etched with a mixed solution of $HF:HNO_3$=1:2 before being subjected to the aforementioned temperature change, unevenness occurs at a polarization-reversed portion because of a difference between the etching rates, so that polarization reversion can be confirmed. This can confirm that electric polarization has been reversed at a portion exposed to the infrared laser light 5.

If an electrostatic latent image has been formed in the LN thin film 11 in the way mentioned above, the electrostatic latent image can be developed as a toner image in the same manner as that described with reference to FIG. 1 and the toner image can be transferred to recording paper.

Next, a second embodiment of the present invention will be described. This embodiment employs an image formation medium in which a thin film of $LiTaO_3$, instead of the LN thin film 11 employed in the above-mentioned first embodiment, is formed as an image formation layer. As with the first embodiment, a carbon conductive film 12, which functions as both a conductive film and a photothermal conversion film, is formed on the $LiTaO_3$ thin film.

With the image formation medium of the second embodiment, an image was formed in similar steps to those shown in FIG. 3. As a result, it has been confirmed, as with the first embodiment, that electric polarization has been reversed at an exposed portion of the $LiTaO_3$ thin film and that a polarization-reversed portion and a non-reversed portion have opposite polarities.

Figure 4:
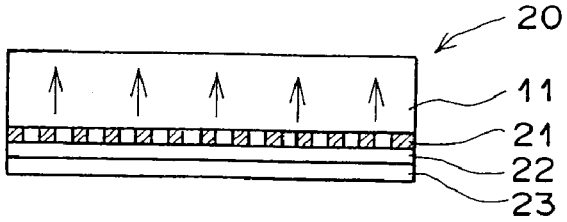
FIG. 4 is a schematic diagram showing an image formation medium employed in an image forming method of a third embodiment of the present invention.

FIG. 4 illustrates a third embodiment of the present invention. Notice in FIG. 4 that the same reference numerals will be applied to the same elements as those in FIG. 3 and that a description thereof will not be given unless particularly necessary (the same applies to the following description).

An image formation medium 20 in the third embodiment consists of a conductive film 22, a $SiO_2$ film 22 as an electric insulating film, and a carbon film 23 as a photothermal conversion film, formed on an LN thin film 11 in the recited order. The conductive film 21 has conducting portions, which are composed of an indium tin oxide (ITO), and non-conducting portions. The conducting portions and the non-conducting portions are alternated in cycles of 10 $\mu$m. The conductive film 12 in this case may be an opaque conductive film such as metal, because the photothermal conversion film absorbs infrared light.

With the image formation medium 20 of the third embodiment, an image was formed in similar steps to those shown in FIG. 3. As a result, it has been confirmed, as with the first embodiment, that electric polarization has been reversed periodically at the exposed portions of the LN thin film 11. The period of the polarization reversions has corresponded to the period of the conducting portions of the conductive film 21. In addition, surface charge was measured with the surface electrometer 13 shown in FIG. 3C. From this measurement it has been confirmed that the surface charge has become zero at portions reversed periodically in electric polarization.

FIG. 5 illustrates a fourth embodiment of the present invention. An image formation medium 30 in the fourth embodiment consists of an LN thin film (image formation layer) 32, which contains metal dopant 31, and a transparent conductive film 33, formed on the LN thin film 32 (in FIG. 5, on the bottom surface), which is transparent to infrared light. The conductive film in this case needs to be transparent because infrared light is absorbed in the image formation medium.

The LN thin film 32 containing the metal dopant 31 can be formed by adding dopant, containing metal which absorbs infrared light, to an LN thin film, and by depositing metal particles by a thermal process, etc., when forming the thin film by the aforementioned sol-gel method. The metal dopant 31 can be formed by suitably employing at least any one of elements Mg, Ti, Cr, Ni, Cu, Zn, Zr, Nb, Mo, Rh, Ag, In, Sn, Au, and Pb.

Figure 5A:
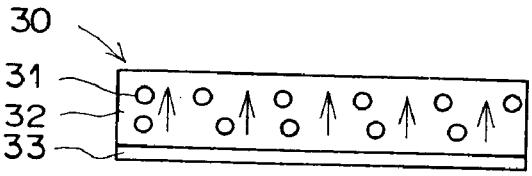
FIGS. 5A and 5B are schematic diagrams showing some of the steps of an image forming method, employing ferroelectrics, of a fourth embodiment of the present invention.
Figure 5B:
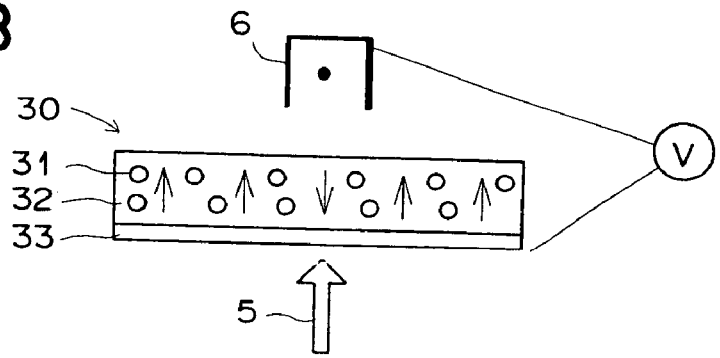

The LN thin film 32 is subjected to the unipolar polarization process prior to image formation by application of an electric field, as illustrated in FIG. 5A. Then, light carrying image information, such as high-output infrared laser light 5, is irradiated to the LN thin 32, as illustrated in FIG. 5B. In the fourth embodiment, the LN thin film 32 is exposed based on image information, by modulating and scanning the infrared laser light 5, based on the image information.

The infrared laser light 5 is absorbed in the metal dopant 31 and converted into heat. With the heat, the LN thin film 32 is heated. At the same time, an electric field is applied across the LN thin film 32 without contact by a corona charging head 6. At this time, at only an exposed portion of the film 32 irradiated with the infrared laser light 5, a polarization reversion threshold value for the LN thin film 32 is reduced by heating. Therefore, only the exposed portion is reversed in polarization direction by suitably setting a value for an electric field. Thereafter, if the temperature of the LN thin film 11 is varied from room temperature to 100° C. as an example, as in the first embodiment, surface charges are generated by the pyroelectric effect.

As with the first embodiment, it can also be confirmed in the fourth embodiment that electric polarization has been reversed at the exposed portions of the LN thin film 32 and that the polarization-reversed portion and the non-reversed portion have opposite polarities.

Figure 6:
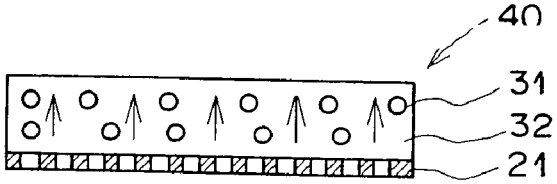
FIG. 6 is a schematic diagram showing an image formation medium employed in an image forming method of a fifth embodiment of the present invention.
Figure 7A:
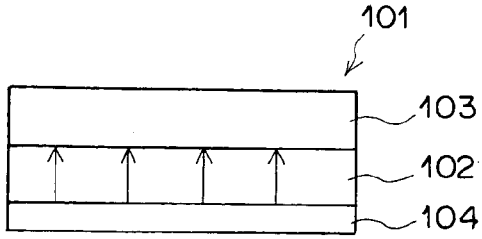
FIGS. 7A to 7D are diagrams used to explain the mechanism of an image display method employing the image forming method of the present invention, in the case of displaying a monochrome image.
Figure 7B:
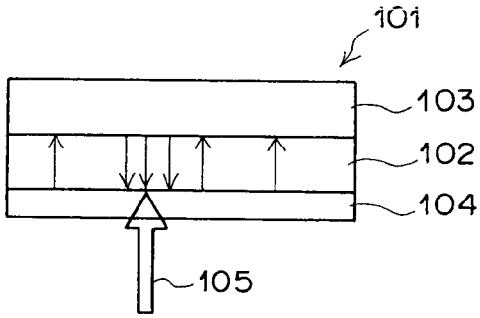
Figure 7C:
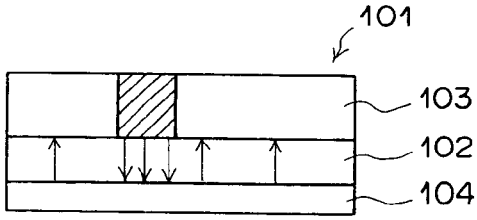
Figure 7D:
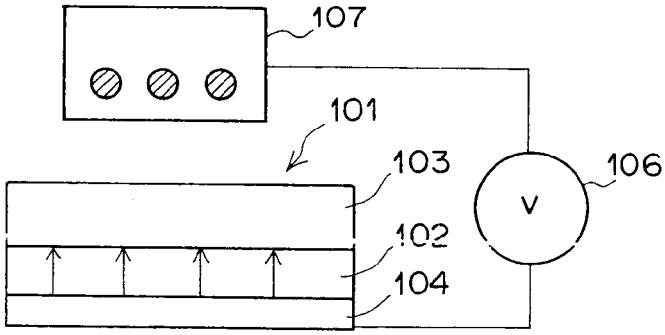

FIG. 6 illustrates a fifth embodiment of the present invention. An image formation medium 40 in the fifth embodiment consists of an LN thin film (image formation layer) 32, which contains metal dopant 31, and a transparent conductive film 33, formed on the LN thin film 32, which is the same as that shown in FIG. 4. The conductive film in this case needs to be transparent because infrared light is absorbed in the image formation medium.

The LN thin film 32 containing the metal dopant 31 is the same in construction and fabrication process as that in the fourth embodiment. The conductive film 21 has conducting portions, which are composed of an indium tin oxide (ITO), and non-conducting portions. The conducting portions and the non-conducting portions are alternated in cycles of 10 $\mu$m.

With the image formation medium 40 of the fifth embodiment, an image was formed in similar steps to those shown in FIG. 3. As a result, it has been confirmed, as with the third embodiment, that electric polarization has been reversed periodically at the exposed portions of the LN thin film 32. The period of the polarization reversions has corresponded to the period of the conducting portions of the conductive film 21. In addition, surface charge was measured with the surface electrometer 13 shown in FIG. 3C. From this measurement it has been confirmed that the surface charge has become zero at portions reversed periodically in electric polarization.

While it has been described that the electrostatic latent image formed in the image formation medium is developed with toner and transferred to recording paper, the image forming method of the present invention is also capable of directly making an image display medium (which is an image formation medium) display an image. A description will hereinafter be given of embodiments that perform such image display.

FIG. 11 illustrates the steps of an image display method, employing ferroelectrics, of a sixth embodiment of the present invention. An image display medium 121 in this embodiment is used for displaying a monochrome image. As illustrated in FIG. 11A, the image display medium 121 has a Z-cut $LiNbO_3$ substrate (hereinafter referred to as an LN substrate) 122, a photothermal conversion film 126 formed on the −Z surface 122*b* of the LN substrate 122, and a transparent conductive film 124 formed on the photothermal conversion film 126 (in FIG. 11A, on the bottom surface). As illustrated in FIG. 11B, the image display medium 121 further has a contrast display body 123 disposed on the +Z surface 122*a* of the LN substrate 122.

The contrast display body 123 constituting the image display medium 121 is constructed, for example, of toner particles (which are charged particles) dispersed into a support body in the form of a sheet. This contrast display body 123 may be formed directly on the +Z surface 122*a* of the LN substrate 122, or may be formed independently into a sheet and bonded to the +Z surface 122*a*. The photo thermal conversion film 126 is used for absorbing infrared light and converting it into heat and is formed, for example, from carbon, thin metal film, organic material for infrared-ray absorption, etc. The transparent conductive film 124 is formed, for example, from an indium tin oxide (ITO), etc.

Figure 11A:
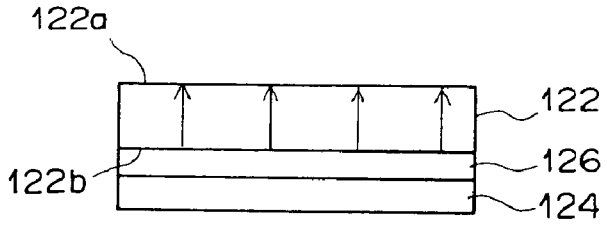
FIGS. 11A to 11D are schematic diagrams showing the steps of an image display method of a sixth embodiment of the present invention.
Figure 11B:
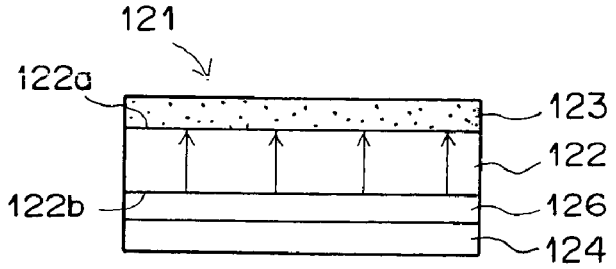
Figure 11C:
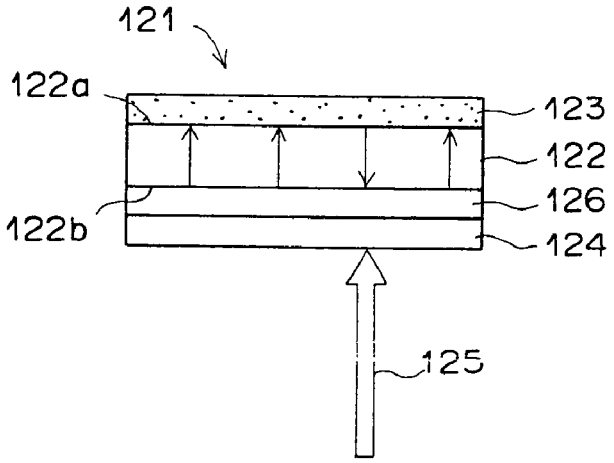
Figure 11D:
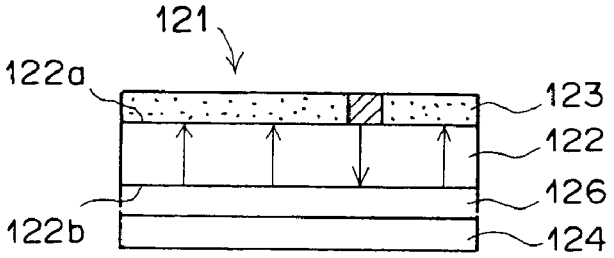
Figure 12A:
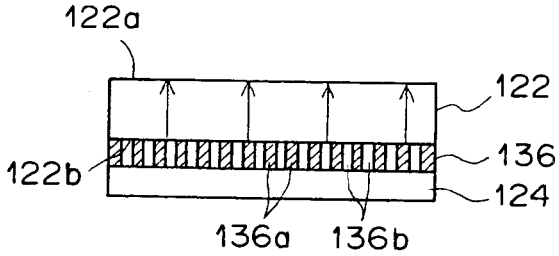
FIGS. 12A to 12D are schematic diagrams showing the steps of an image display method of a seventh embodiment of the present invention.
Figure 12B:
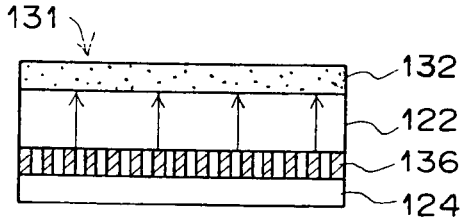
Figure 12C:
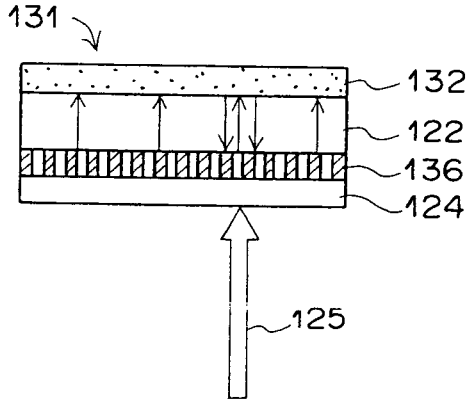
Figure 12D:
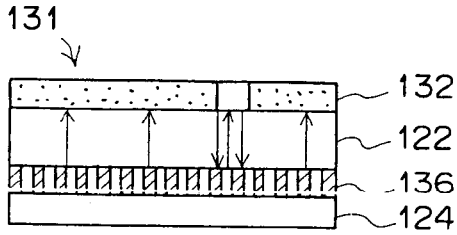

In displaying an image on the image display medium 121 of the sixth embodiment, the unipolar polarization process (reset process) is performed beforehand by application of an electric field to the LN substrate 122. Then, infrared laser light 125 with a predetermined wavelength carrying monochrome-image information is irradiated to the photothermal conversion film 126 through the transparent conductive film 124. A portion of the photothermal conversion film 126 irradiated with the infrared laser light 125 generates heat, which is transferred to the LN thin substrate 122. Consequently, the heated portion of the LN thin substrate 122 reverses in polarization direction, as illustrated in FIG. 11D. Note that in order to cause the infrared laser light 125 to carry image information, the infrared laser light 125 is scanned in two dimensions on the photothermal conversion film 126, for example, with the intensity modulated according to image information.

At the polarization-reversed portion of the LN substrate 122, surface charge, which is opposite to that on a remaining portion subjected to the unipolar polarization process, is induced. Hence, the toner particles, dispersed into the contrast display body 123, and having a polarity opposite to that of the aforementioned surface charge, are condensed at the polarization-reversed portion of the LN substrate 122. The polarization-reversed portion is colored, so that contrast occurs. In this manner, a monochrome image is displayed on the contrast display body 123 in accordance with the image in formation carried by the infrared laser light 125.

Erasing of this display image, that is, the reset process is performed in the same manner as that described previously with reference to FIG. 7.

Note that a polarization-reversion threshold voltage for the LN substrate 122 maybe lowered to facilitate polarization reversion by utilizing the aforementioned transparent conductive film 124, etc., to apply bias voltage between the +Z surface 122*a* and −Z surface 122*b* of the LN substrate 122. In that case it is desirable to apply voltage without contact by the corona charging method described previously with reference to FIG. 7. In the case where it becomes a hindrance when applying bias voltage, the contrast display body 123 may be bonded after application of the bias voltage.

The occurrence of polarization reversion at portions of the LN substrate 122 corresponding to the infrared-laser-light irradiated portions of the photothermal conversion film 126 can be confirmed by etching the surface of the LN substrate 122 with a mixed solution of HF: $HNO_3$=1:2 and observing the etched surface. Since the etching rate varies with a direction of polarization, unevenness occurs between a polarization-reversed portion and a non-reversed portion, so that polarization reversion can be confirmed by this unevenness. In addition, if a charge distribution for the +Z surface of the LN substrate 122 is measured with a surface electrometer, it can be confirmed that the polarity of electric charge at a polarization-reversed portion is the opposite of that at a non-reversed portion, whereby polarization reversion can also be confirmed.

FIG. 12 illustrates the steps of an image display method, employing ferroelectrics, of a seventh embodiment of the present invention. An image display medium 131 in this embodiment is used to display a monochrome image. As illustrated in FIG. 12A, the image display medium 131 has a Z-cut LN substrate 122, a periodic photothermal conversion film 136 formed on the −Z surface 122*b* of the LN substrate 122, and a transparent conductive film 124 formed on the photothermal conversion film 136 (in FIG. 12B, on the bottom surface). As illustrated in FIG. 12B, the image display medium 131 further has a contrast display body 132 disposed on the +Z surface 122*a* of the LN substrate 122.

The contrast display body 132 constituting the image display medium 131 is formed, for example, by forming the aforementioned electrochromic material into a sheet. As suitable electrochromic materials, there are conductive polymer (organic electrochromic) materials, such as polyaniline, polypyrrole, and polythiophene, and inorganic electrochromatic materials such as tungsten oxide and molybdenum oxide. This contrast display body 132 may be formed directly on the +Z surface 122*a* of the LN substrate 122, or may be formed independently into a sheet and bonded to the +Z surface 122*a*.

Figure 13:
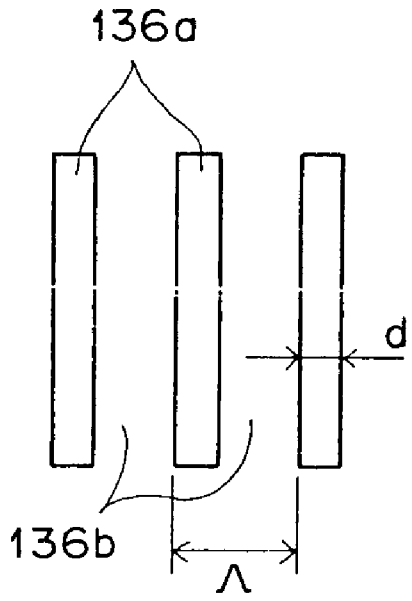
FIG. 13 is a schematic plan view showing part of the periodic photothermal conversion film employed in the image display method of the seventh embodiment.

The periodic photothermal conversion film 136 is constructed of microphotothermal conversion portions 136*a*, which absorb infrared light and convert it into heat, and non-conversion portions 136*b*. The micro photothermal conversion portions 136*a* and non-conversion portions 136*b* are periodically repeated. The photothermal conversion portions 136*a* are formed, for example, from carbon, thin metal film, organic material for infrared-ray absorption, etc. As schematically illustrated in FIG. 13, the period Λ between the photothermal conversion portions 136*a* is about 10 to 30 μm and the duty ratio (=linewidth d/period Λ) is about 15%.

In displaying an image on the image display medium 131 of the seventh embodiment, the unipolar polarization process (reset process) is performed beforehand by application of an electric field to the LN substrate 122. Then, infrared laser light 125 with a predetermined wavelength carrying monochrome-image information is irradiated to the periodic photothermal conversion film 136 through the transparent conductive film 124. The photothermal conversion portion 136*a* of the periodic photothermal conversion film 136 irradiated with the infrared laser light 125 generates heat, which is transferred to the LN thin substrate 122. Consequently, the heated portion of the LN thin substrate 122 reverses in polarization direction. As the photothermal conversion portions 136*a* are periodically repeated with the micro non-conversion portions 136 interposed there between, the aforementioned effect of canceling adjacent charges occurs. With this effect, surface charge becomes almost zero at a portion of the LN substrate 122, corresponding to the portion of the periodic photothermal conversion film 136 irradiated with the infrared laser light 125, that is, the periodic polarization-reversed portion.

Hence, the electrochromic phenomenon does not develop at a portion of the contrast display body 132 in contact with the aforementioned periodic polarization-reversed portion of the LN substrate 122, but develops at portions of the contrast display portion 132 in contact with portions of the LN substrate 122 other than that (i.e., portions that remain subjected to the unipolar polarization process). Consequently, contrast occurs. In this way, a monochrome image is displayed on the contrast display body 132 in accordance with the image information carried by the infrared laser light 125.

In the seventh embodiment, the occurrence of polarization reversion at portions of the LN substrate 122 corresponding to the infrared-laser-light irradiated portions of the periodic photothermal conversion film 136 can be confirmed by the method described in the aforementioned sixth embodiment. It can also be confirmed with the aforementioned measurement by the surface electrometer that surface charge is nearly zero at portions of the LN substrate 122 corresponding to the infrared-laser-light irradiated portions of the periodic photothermal conversion film 136.

Figure 14:
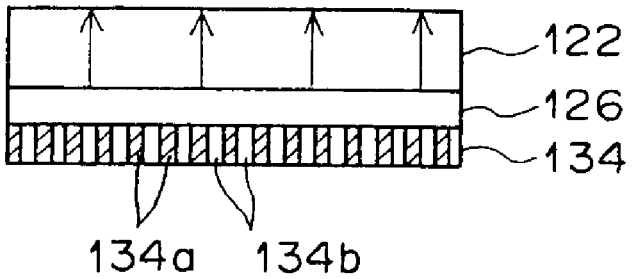
FIG. 14 is a schematic side view showing a variation of the image display medium employed in the image display method of the seventh embodiment.

Note that, as illustrated in FIG. 14, even if a photothermal conversion film 126 that performs photothermal conversion over the entire surface is employed instead of the aforementioned periodic photothermal conversion film 136, and even if a periodic transparent conductive film 134, which consists of micro conducting portions 134*a* and non-conducting portions 134*b* repeated periodically, is employed instead of the aforementioned transparent conductive film 124, the same operation and effect as in the aforementioned embodiment can be obtained by operation of the periodic transparent conductive film 134.

In the case of FIG. 14, the aforementioned bias voltage is applied across the LN substrate 122 in parallel with irradiation of the infrared laser light 125 by utilizing the transparent conductive film 124, etc. A polarization reversion threshold voltage for a portion of the LN substrate 122 corresponding to the conducting portion 134*a* is then reduced by the effect of the bias voltage application, and consequently, polarization reversion is facilitated. On the other hand, such operation is not obtained at a portion of the LN substrate corresponding to the non-conducting portion 134*b*. Consequently, the surface charge on the LN substrate 122 approaches zero by the aforementioned effect of canceling adjacent charges.

In the case of FIG. 14, therefore, surface charge is no longer zero at a portion of the LN substrate 122 corresponding to the infrared-laser-light irradiated portion of the photothermal conversion film 126 and remains nearly zero at a portion of the LN substrate 122 corresponding to the non-irradiated portion of the photothermal conversion film 126. Consequently, contrast can be displayed by developing the electrochromic phenomenon in the contrast display body 132 at infrared-light irradiated portions and not developing it at non-irradiated portions.

Next, a description will be given of an eighth embodiment of the present invention. It is effective in the image display method of the present invention to reduce the thickness of ferroelectrics to lower a polarization reversion threshold voltage for the ferroelectrics. For this reason, the eighth embodiment employs a thin film of ferroelectrics instead of the LN substrate 122 employed in the seventh embodiment. The remaining construction is basically the same as the seventh embodiment.

In the eighth embodiment, a thin film of $LiNbO_3$ with a film thickness of about 10 $\mu$m is obtained by hydrolysis of $LiOC_2H_5$ and $Nb(OC_2H_5)$, with the metal alkoxides as starting materials (sol-gel method). The obtained thin film of $LiNbO_3$ is employed as the aforementioned thin film of ferroelectrics.

With such a thin film of $LiNbO_3$, a monochrome image can also be displayed on the contrast display body 132, as with the seventh embodiment.

It has also been confirmed that even if the aforementioned $LiNbO_3$ thin film instead of the LN substrate 122 is employed in the sixth embodiment described previously, a monochrome image can likewise be displayed.

Figure 15A:
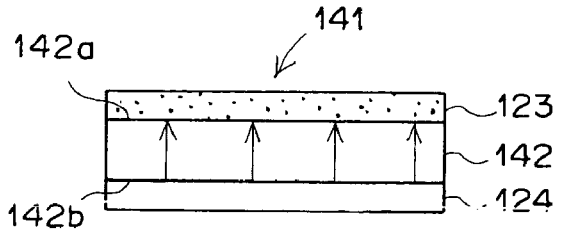
FIGS. 15A and 15B are diagrams showing the steps of an image display method of a ninth embodiment of the present invention.
Figure 15B:
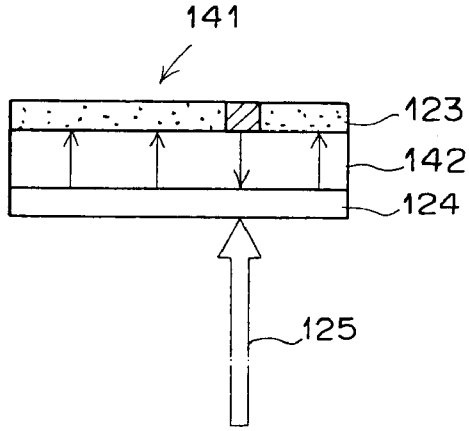

FIG. 15 illustrates the steps of an image display method, employing ferroelectrics, of a ninth embodiment of the present invention. An image display medium 114 in the ninth embodiment is also employed to display a monochrome image. As illustrated in FIG. 15A, the image display medium 114 is constructed of a thin film of $LiNbO_3$ 142 containing a dopant which absorbs infrared light (hereinafter referred to as a doped LN thin film 142), a contrast display body 123 joined to one surface 142*a* of the doped LN thin film 142, and a transparent conductive film 124 formed on the other surface 142*b* of the doped LN thin film 142.

The doped LN thin film 142 is formed by adding dopant, containing metal which absorbs infrared light, to an LN thin film, and by depositing metal particles by a thermal process, etc., when forming the thin film. As described previously, it is preferable that the dopant contain at least any one of elements Mg, Ti, Cr, Ni, Cu, Zn, Zr, Nb, Mo, Rh, Ag, In, Sn, Au, and Pb. The contrast display body 123, as with that employed in the sixth embodiment, is constructed, for example, of toner particles (which are charged particles) dispersed into a support body in the form of a sheet.

In displaying an image on the image display medium 141 of the ninth embodiment, the unipolar polarization process (reset process) is performed beforehand by application of an electric field to the LN substrate 142. Then, infrared laser light 125 carrying image information is irradiated directly to the doped LN thin film 142 through the transparent conductive film 124. The aforementioned dopant contained in the doped LN thin film 142 then absorbs the infrared laser light 125 and generates heat, which is transferred to the doped LN thin film 142. Consequently, at the heated portion of the doped LN thin film 142, that is, the portion irradiated with the infrared laser light 125, the polarization direction of the doped LN thin film 142 reverses.

At the polarization-reversed portion of the doped LN thin film 142, surface charge, which is opposite to that on a remaining portion subjected to the unipolar polarization process, is induced. Hence, the toner particles, dispersed into the contrast display body 123, and having a polarity opposite to that of the aforementioned surface charge, are condensed at the polarization-reversed portion of the doped LN thin film 142. The polarization-reversed portion is colored, so that contrast occurs. In this manner, a monochrome image is displayed on the contrast display body 123 in accordance with the image information carried by the infrared laser light 125.

The ninth embodiment is also capable of obtaining the same operation and effect as the case where the periodic transparent conductive film 134 shown in FIG. 14 is employed in the seventh embodiment, by applying bias voltage across the doped LN thin film 142 through the transparent conductive film 134 instead of employing the transparent conductive film 124.

Figure 16A:
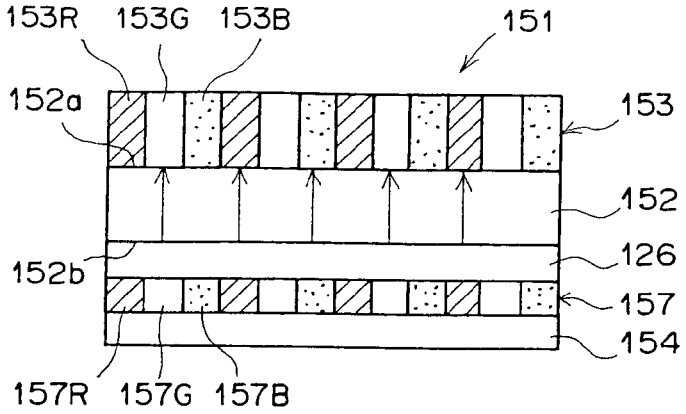
FIGS. 16A and 16B are diagrams showing the steps of an image display method of a tenth embodiment of the present invention.

FIG. 16 illustrates the steps of an image display method, employing ferroelectrics, of a tenth embodiment of the present invention. An image display medium 151 in the tenth embodiment is employed for displaying a color image. As illustrated in FIG. 16A, the image display medium 151 is constructed of a thin film of $LiNbO_3$ (hereinafter referred to as a LN thin film) 152, a three-color contrast display body 153 joined to one surface 152*a* of the LN thin film 152, a photothermal conversion film 126 formed on the other surface 152*b* of the LN thin film 152, a three-wavelength light transmission film 157 formed on the photothermal conversion film 126 (in FIG. 16A, on the bottom surface), and a transparent electrode 154 formed on the three-wavelength light transmission film 157.

Figure 10A:
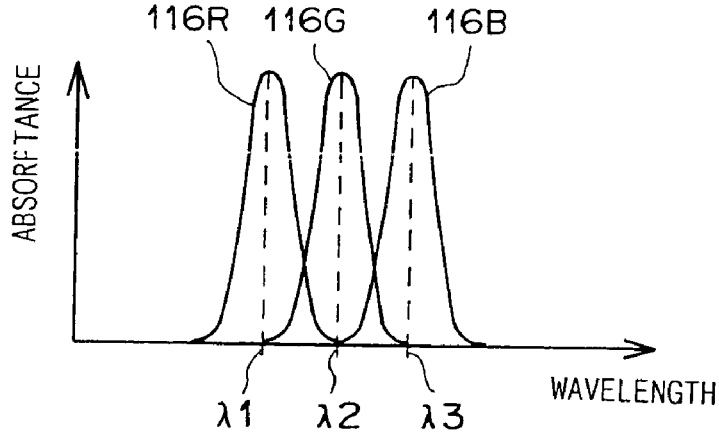
FIG. 10A is a graph showing spectral-absorptance characteristics for a 3-wavelength photothermal conversion film employed in displaying a color image.
Figure 10B:
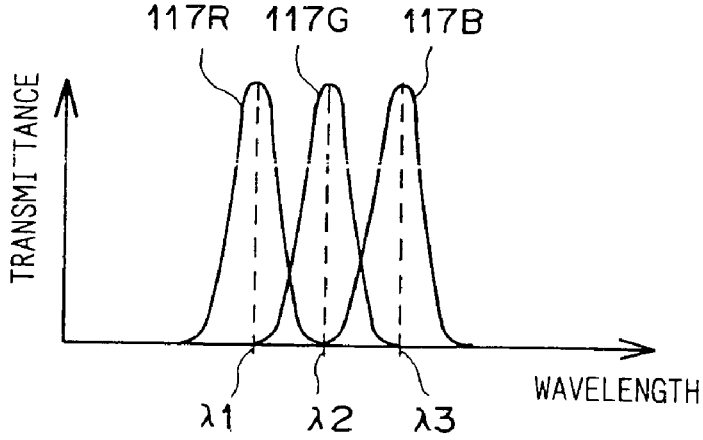
FIG. 10B is a graph showing spectral-transmittance characteristics for the 3-wavelength photothermal conversion film.

The three-wavelength light transmission film 157 consists of three kinds of micro filters 157R, 157G, and 157B disposed regularly. These three kinds of micro filters 157R, 157G, and 157B selectively transmit infrared light of different wavelengths $\lambda 1$, $\lambda 2$, and $\lambda 3$, respectively. The spectral-transmittance characteristics for these micro filters 157R, 157G, and 157B are basically the same as those of the micro filters 117R, 117G, and 117B described with reference to FIG. 10B. The size of the micro filters 157R, 157G, and 157B corresponds to the size of a pixel required of a display image and is, for example, about a few gm square.

The micro filters 157R, 157G, and 157B can be formed, for example, by the steps of stacking a first color filter on a support body through a shadow mask provided with a large number of holes corresponding to color pixels, then stacking a second color filter with the shadow mask shifted, and stacking a third color filter with the shadow mask further shifted. More specifically, the microfilters 157R, 157G, and 157B can be formed by a deposited film of oxide.

The contrast display body 113 is made up of color-emitting toners 153R, 153G, and 153B, carried by a support sheet. These color-emitting toners 153R, 153G, and 153B emit red, green, and blue in accordance with electric charge received from the outside. The size of the color-emitting toners 153R, 153G, and 153B is the same as that of the micro filters 157R, 157G, and 157B, and are disposed at positions corresponding to the micro filters 157R, 157G, and 157B, respectively.

Figure 16B:
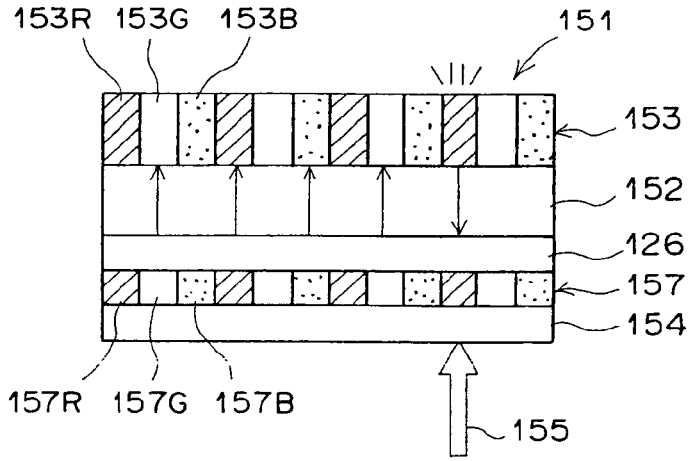

In displaying an image on the image display medium 151 of the tenth embodiment, the unipolar polarization process (reset process) is performed beforehand by application of an electric field to the LN substrate 122. This state is illustrated in FIG. 16A. Then, infrared laser light 155 of wavelength λ1 carrying red image information is irradiated toward the photothermal conversion film 126 through the transparent electrode 154 and the three-wavelength light transmission film 157, as illustrated in FIG. 16B. To make the infrared laser light 155 carry red image information, the infrared laser light 155 is scanned in two dimensions on the three-wavelength light transmission film 157, for example, with the intensity modulated.

At the portion of the micro filter 157R, irradiated with the infrared laser light 155 of wavelength λ1, of the micro filters 157R, 157G, and 157B, the infrared laser light 155 transmits through the three-wavelength light transmission film 157 and reaches the photothermal conversion film 126. This portion of the photothermal conversion film 126 generates heat, so that a polarization direction for a portion of the LN thin film 152 in contact with the heat generating portion reverses. At the polarization-reversed portion of the LN thin film 152, surface charge with the opposite polarity to a remaining portion subjected to the unipolar polarization process is induced. The electric charge with this polarity causes the color-emitting toner 153R of the three-color contrast display body 153 to emit red.

If, in parallel with irradiation of the infrared laser light 155 of wavelength λ1, the infrared laser light 155 of wavelength λ2 carrying green image information is scanned in two dimensions on the three-wavelength light transmission film 157, a portion of the photothermal conversion film 126, corresponding to the micro filter 157G through which the infrared laser light 155 of wavelength λ2 is transmitting, generates heat, so that a polarization direction for a portion of the LN thin film 152 in contact with the heat generating portion reverses. At the polarization-reversed portion of the LN thin film 152, surface charge with the opposite polarity to a remaining portion subjected to the unipolar polarization process is induced. The electric charge with this polarity causes the color-emitting toner 153G of the three-color contrast display body 153 to emit green.

In addition, if the infrared laser light 155 of wavelength λ3 carrying blue image information is similarly scanned in two dimensions on the three-wavelength light transmission film 157, a portion of the photothermal conversion film 126, corresponding to the micro filter 157B through which the infrared laser light 155 of wavelength λ3 is transmitting, generates heat, so that a polarization direction for a portion of the LN thin film 152 in contact with the heat generating portion reverses. At the polarization-reversed portion of the LN thin film 152, surface charge with the opposite polarity to a remaining portion subjected to the unipolar polarization process is induced. The electric charge with this polarity causes the color-emitting toner 153B of the three-color contrast display body 153 to emit blue.

As described above, the color emissions of the color-emitting toners 153R, 153G, and 153B arrayed in the three-color contrast display body 153 are controlled based on red image information, green image information, and blue image information, respectively. Consequently, a full color image can be displayed on the three-color contrast display body 153 in accordance with the red, green, and blue image information.

In the tenth embodiment, polarization reversion for the LN thin film 152 has also been confirmed by the etching method described previously in the sixth embodiment. In addition, it has been confirmed, by measurements made with the aforementioned surface electrometer, that a surface charge distribution for the LN thin film 152 has been obtained as described above, in accordance with irradiation of the infrared laser light 155 with wavelengths of λ1, λ2, and λ3.

Figure 17:
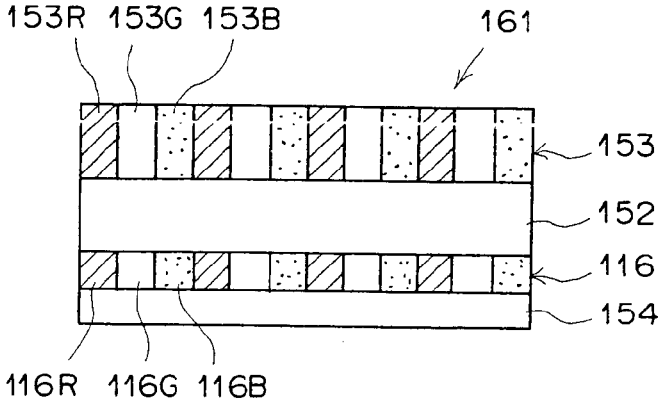
FIG. 17 is a schematic side view showing an image display medium employed in an image display method of an eleventh embodiment of the present invention.

FIG. 17 illustrates an image display medium 161 employed in an image display method of an eleventh embodiment of the present invention. This image display medium 161 is also used for displaying a color image. The image display medium 161 is the same as the image display medium 151 shown in FIG. 16, except that the photothermal conversion film 126 and the three-wavelength light transmission film 157 are replaced with a single three-wavelength photothermal conversion film 116.

Figure 8A:
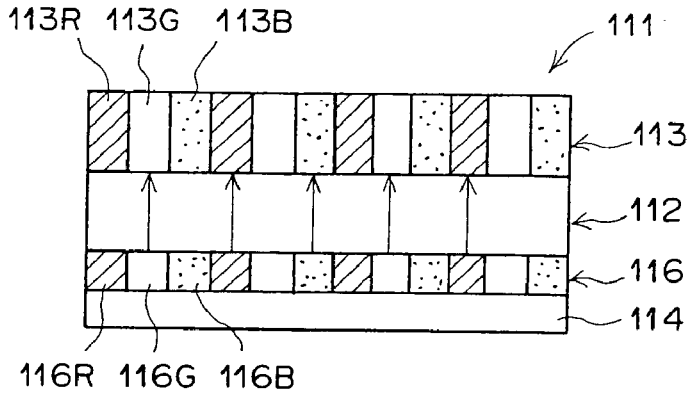
FIGS. 8A and 8B are diagrams used for explaining the mechanism of an image display method employing the image forming method of the present invention, in the case of displaying a color image.
Figure 8B:
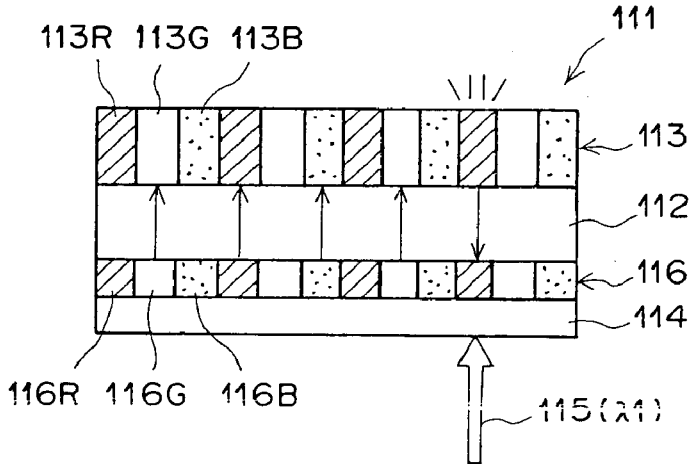
Figure 9:
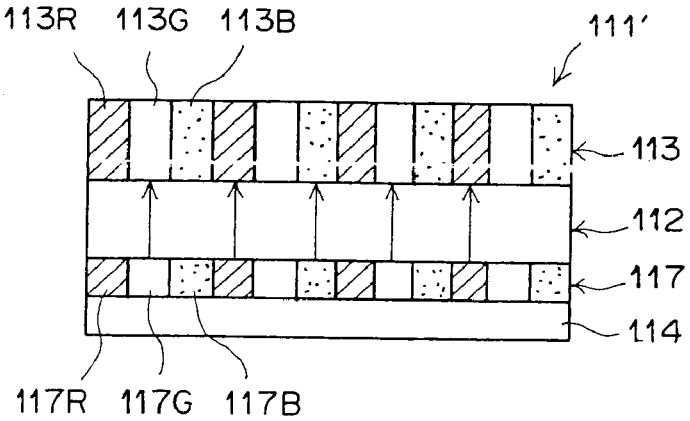
FIG. 9 is a side view showing a variation of the image display medium shown in FIG. 8.

The three-wavelength photothermal conversion film 116 is the same as that shown in FIG. 8. Because the image display medium 161 with the photothermal conversion film 116 is basically the same as the image display medium 111 shown in FIG. 8 and has the same operation and effect, a detailed description thereof is omitted.

While certain representative embodiments and details have been shown for the purpose of illustrating the present invention, it will be apparent to those skilled in this art that various changes and modifications may be made without departing from the scope of the invention hereinafter claimed.

What is claimed is:

1. An image forming method comprising the steps of:

subjecting ferroelectrics to a distribution of heat corresponding to image information simultaneously with application of an electric field, in order to form a polarization reversion pattern in said ferroelectrics in accordance with said image information;

applying a change in temperature to said ferroelectrics so that surface charges corresponding to said polarization reversion pattern are generated by a pyroelectric effect; and obtaining an electrostatic latent image by said surface charges;

wherein an inorganic ferroelectric oxide is employed as said ferroelectrics.

2. The image forming method as set forth in claim 1, wherein infrared light carrying said image information is irradiated to said inorganic ferroelectric oxide to apply said distribution of heat to said inorganic ferroelectric oxide.

3. The image forming method as set forth in claim 1, wherein application of said electric field is performed by a corona charging method.

4. The image forming method as set forth in claim 2, wherein application of said electric field is performed by a corona charging method.

5. The image forming method as set forth in claim 2, wherein a photothermal conversion body, which absorbs said infrared light and converts it into heat and applies said heat to said inorganic ferroelectric oxide, is disposed in close proximity or intimate contact with said inorganic ferroelectric oxide.

6. The image forming method as set forth in claim 1, wherein a conductive film is disposed on one surface of said inorganic ferroelectric oxide, and said electric field is applied across said in organic ferroelectric oxide through said conductive film.

7. The image forming method as set forth in claim 2, wherein a conductive film is disposed on one surface of said inorganic ferroelectric oxide, and said electric field is applied across said inorganic ferroelectric oxide through said conductive film.

8. The image forming method as set forth in claim 3, wherein a conductive film is disposed on one surface of said inorganic ferroelectric oxide, and said electric field is applied across said in organic ferroelectric oxide through said conductive film.

9. The image forming method as set forth in claim 5, wherein a conductive film is disposed on one surface of said inorganic ferroelectric oxide, and said electric field is applied across said in organic ferroelectric oxide through said conductive film.

10. The image forming method as set forth in claim 6, wherein said conductive film is constructed of micro conducting portions and non-conducting portions.

11. The image forming method as set forth in claim 10, wherein said micro conducting portions and non-conducting portions are alternated in predetermined cycles.

12. The image forming method as set forth in claim 6, wherein said conductive film is transparent to said infrared light.

13. The image forming method as set forth in claim 1, wherein said inorganic ferroelectric oxide is a thin film with metal alkoxides as raw materials.

14. The image forming method as set forth in claim 2, wherein said inorganic ferroelectric oxide is a thin film with metal alkoxides as raw materials.

15. The image forming method as set forth in claim 3, wherein said inorganic ferroelectric oxide is a thin film with metal alkoxides as raw materials.

16. The image forming method as set forth in claim 5, wherein said inorganic ferroelectric oxide is a thin film with metal alkoxides as raw materials.

17. The image forming method as set forth in claim 6, wherein said inorganic ferroelectric oxide is a thin film with metal alkoxides as raw materials.

18. The image forming method as set forth in claim 10, wherein said inorganic ferroelectric oxide is a thin film with metal alkoxides as raw materials.

19. The image forming method as set forth in claim 11, wherein said inorganic ferroelectric oxide is a thin film with metal alkoxides as raw materials.

20. The image forming method as set forth in claim 12, wherein said inorganic ferroelectric oxide is a thin film with metal alkoxides as raw materials.

21. The image forming method as set forth in claim 1, wherein said inorganic ferroelectric oxide is $LiNb_xTa_{1-x}O_3$ ($0 \leqq x < 1$).

22. The image forming method as set forth in claim 2, wherein said inorganic ferroelectric oxide is $LiNb_xTa_{1-x}O_3$ ($0 \leqq x \leqq 1$).

23. The image forming method as set forth in claim 3, wherein said inorganic ferroelectric oxide is $LiNb_xTa_{1-x}O_3$ ($0 \leqq x \leqq 1$).

24. The image forming method as set forth in claim 5, wherein said inorganic ferroelectric oxide is $LiNb_xTa_{1-x}O_3$ ($0 \leqq x \leqq 1$).

25. The image forming method as set forth in claim 6, wherein said inorganic ferroelectric oxide is $LiNb_xTa_{1-x}O_3$ ($0 \leqq x \leqq 1$).

26. The image forming method as set forth in claim, 10, wherein said inorganic ferroelectric oxide is $LiNb_xTa_{1-x}O_3$ ($0 < x \leqq 1$).

27. The image forming method as set forth in claim 11, wherein said inorganic ferroelectric oxide is $LiNb_xTa_{1-x}O_3$ ($0 \leqq x \leqq 1$).

28. The image forming method as set forth in claim 12, wherein said inorganic ferroelectric oxide is $LiNb_xTa_{1-x}O_3$ ($0 \leqq x \leqq 1$).

29. The image forming method as set forth in claim, 2, wherein said inorganic ferroelectric oxide contains a dopant that absorbs said infrared light.

30. The image forming method as set forth in claim 29, wherein said dopant is composed of at least any one of elements Mg, Ti, Cr, Ni, Cu, Zn, Zr, Nb, Mo, Rh, Ag, In, Sn, Au, and Pb.

31. The image forming method of claim 21, wherein the $LiNb_xTa_{1-x}O_3$ has a mono-crystalline structure.

32. In an image formation medium, comprising an image formation layer, which is employed in the image forming method as set forth in any one of claims 1 through 3, the improvement wherein said image formation layer is composed of an inorganic ferroelectric oxide.

33. The image formation medium as set forth in claim 32, wherein said inorganic ferroelectric oxide contains a dopant that absorbs infrared light carrying image information.

34. The image formation medium as set forth in claim 33, wherein said dopant is composed of at least anyone of elements Mg, Ti, Cr, Ni, Cu, Zn, Zr, Nb, Mo, Rh, Ag, In, Sn, Au, and Pb.

35. The image formation medium as set forth in claim 32, wherein a photothermal conversion layer, which absorbs infrared light carrying image information and converts it into heat and applies said heat to said image formation layer, is disposed in close proximity or intimate contact with said image formation layer.

36. The image formation medium as set forth in claim 33, wherein a photothermal conversion layer, which absorbs infrared light carrying image information and converts it into heat and applies said heat to said image formation layer, is disposed in close proximity or intimate contact with said image formation layer.

37. The image formation medium as set forth in claim 34, wherein a photothermal conversion layer, which absorbs infrared light carrying image information and converts it into heat and applies said heat to said image formation layer, is disposed in close proximity or intimate contact with said image formation layer.

38. The image formation medium as set forth in claim 32, wherein said inorganic ferroelectric oxide is a thin film with metal alkoxides as raw materials.

39. The image formation medium as set forth in claim 33, wherein said inorganic ferroelectric oxide is a thin film with metal alkoxides as raw materials.

40. The image formation medium as set forth in claim 34, wherein said inorganic ferroelectric oxide is a thin film with metal alkoxides as raw materials.

41. The image formation medium as set forth in claim 35, wherein said inorganic ferroelectric oxide is a thin film with metal alkoxides as raw materials.

42. The image formation medium as set forth in claim 32, wherein said inorganic ferroelectric oxide is $LiNb_xTa_{1-x}O_3$ ($0 \leqq x \leqq 1$).

43. The image formation medium as set forth in claim 33, wherein said inorganic ferroelectric oxide is $LiNb_xTa_{1-x}O_3$ ($0 \leqq x \leqq 1$).

44. The image formation medium as set forth in claim 34, wherein said inorganic ferroelectric oxide is $LiNb_xTa_{1-x}O_3$ ($0 \leqq x \leqq 1$).

45. The image formation medium as set forth in claim 39, wherein said inorganic ferroelectric oxide is $LiNb_xTa_{1-x}O_3$ ($0 \leqq x \leqq 1$).

46. The image formation medium as set forth in claim 37, wherein said inorganic ferroelectric oxide is $LiNb_xTa_{1-x}O_3$ ($0 \leqq x \leqq 1$).

47. The image formation medium as set forth in claim 32, wherein a conductive film is disposed on one surface of said inorganic ferroelectric oxide.

48. The image formation medium as set forth in claim 33, wherein a conductive film is disposed on one surface of said inorganic ferroelectric oxide.

49. The image formation medium as set forth in claim 34, wherein a conductive film is disposed on one surface of said inorganic ferroelectric oxide.

50. The image formation medium as set forth in claim 35, wherein a conductive film is disposed on one surface of said inorganic ferroelectric oxide.

51. The image formation medium as set forth in claim 42, wherein a conductive film is disposed on one surface of said inorganic ferroelectric oxide.

52. The image formation medium as set forth in claim 42, wherein a conductive film is disposed on one surface of said inorganic ferroelectric oxide.

53. The image formation medium as set forth in claim 43, wherein said conductive film is constructed of micro conducting portions and non-conducting portions.

54. The image formation medium as set forth in claim 53, wherein said micro conducting portions and non-conducting portions are alternated in predetermined cycles.

55. The image formation medium as set forth in claim 49, wherein said conductive film is transparent to infrared light.

56. The image formation medium as set forth in claim 53, wherein said conductive film is transparent to infrared light.

57. The image formation medium as set forth in claim 54, wherein said conductive film is transparent to infrared light.

58. The image forming method of claim 1, further comprising the step of forming a unipolar polarization pattern in the ferroelectrics prior to forming the polarization reversion pattern.

59. The image forming method of claim 58, wherein the polarization reversion pattern is formed by irradiating the ferroelectrics with light carrying the image information.

60. An image forming apparatus for performing image formation by the image forming method as set forth in any one of claims 1 through 12; 13 through 20, 21 through 30, 31 and 58 through 59.

* * * * *